United States Patent [19]

Zabelin et al.

[11] Patent Number: 4,483,753

[45] Date of Patent: Nov. 20, 1984

[54] METHOD OF CONTINUOUSLY EXTRACTING MAGNESIUM

[75] Inventors: Igor V. Zabelin; Jury M. Ryabukhin, both of Zaporozhie; Murat K. Baibekov, Ust-Kamenogorsk; Vladimir N. Devyatkin; Efim A. Kitaigorodsky, both of Zaporozhie; Arnold V. Kolomiitsev, Ust-Kamenogorsk; Viktor G. Sorokous, Zaporozhie; Ilias A. Chalabaev, Ust-Kamenogorsk; Nikolai M. Zuev, Leningrad; Chaken K. Medeuov, Ust-Kamenogorsk; Alexandr S. Chesnokov, Leningrad; Seisanbai Usenov, Ust-Kamenogorsk; Grigory V. Tsidrintsev, Ust-Kamenogorsk; Mikhail M. Nikolaev, Ust-Kamenogorsk; Alexandr A. Kolyadzin, Ust-Kamenogorsk; Boris A. Smorgunov, Moscow; Alexandr V. Chalov; Viktor V. Asafiev, both of Zaporozhie; Oleg V. Ladaria, Leningrad; Vladimir V. Vukolov, Leningrad; Khamat K. Sabirov, Leningrad; Fedor A. Ivakhno, Zaporozhie, all of U.S.S.R.

[73] Assignees: Vsesojuzny Nauchno-Issledovatelsky I Proektny Institut Titana; UST-Kamenogorsky Titano-Magnievy, both of U.S.S.R.

[21] Appl. No.: 233,900

[22] Filed: Feb. 12, 1981

[51] Int. Cl.[3] ..... C25C 3/04

[52] U.S. Cl. ..... 204/70

[58] Field of Search ..... 204/70

[56] References Cited

U.S. PATENT DOCUMENTS 3,418,223 12/1968 Love ..... 204/70

FOREIGN PATENT DOCUMENTS 0829882 12/1969 Canada ..... 204/70

0259401 4/1968 U.S.S.R. ..... 204/70

*Primary Examiner*—R. L. Andrews

*Assistant Examiner*—Terryence Chapman

*Attorney, Agent, or Firm*—McAulay, Fields, Fisher, Goldstein & Nissen

[57] ABSTRACT

A method of continuously extracting magnesium by subjecting chloride electrolytes to electrolysis consists of enriching an electrolyte in magnesium chloride and refining the same, mixing the enriched electrolyte with the recycled electrolyte containing the magnesium extracted in electrolytic cells, separating the magnesium from the resultant electrolyte, dividing the electrolyte into two flows of which one is fed to be enriched, while the other is delivered to a bank of electrolytic cells series-connected by conduits, delivering the recycled electrolyte containing the extracted magnesium for mixing with the enriched electrolyte prior to the step of separation, accumulating the magnesium and withdrawing the same from the process. In a processing line used for practicing the above method preferably utilized is a multiple-cell flow apparatus comprising a chamber for enriching the electrolyte in magnesium chloride the wall of which having a passage for establishing communication with a chamber for separating magnesium from the electrolyte through a corresponding passage in the wall thereof as well as a chamber for dividing the electrolyte into flows, the chamber for dividing the electrolyte into flows being disposed between said chambers for enriching and separating the electrolyte. In the processing line practicing the method may preferably be used a multiple-cell flow apparatus comprising a chamber for enriching the electrolyte in magnesium chloride the upper part of the wall of the chamber has a passage for establishing communication with a chamber for separating magnesium from the electrolyte through a corresponding passage in the wall thereof as well as a chamber for dividing the electrolyte into flows, the chamber for dividing the electrolyte into flows is disposed between said chambers for enriching and separating the electrolyte.

4 Claims, 11 Drawing Figures

METHOD OF CONTINUOUSLY EXTRACTING MAGNESIUM

BACKGROUND OF THE INVENTION

1. Field of the Invention

The invention relates to a method of continuously extracting magnesium and to a multiple-cell flow apparatus in the processing line for continuously extracting magnesium, particularly by electrolysis.

Continuous methods of extracting magnesium are presently among the most promising trends in promoting further improvements in electrolytic extraction of magnesium.

2. Description of the Prior Art

Known in the art is a method of continuously extracting magnesium by subjecting chloride electrolytes to electrolysis (USSR Inventor's Certificate No. 257,059). The '059 method comprises the steps of adding magnesium chloride to the electrolyte, refining the electrolyte, introducing the resultant electrolyte to a bank of electrolysis cells series-connected by conduits, feeding the electrolyte with the magnesium extracted in the electrolysis cells to separate the magnesium from the electrolyte, accumulating the magnesium and withdrawing the same from the process as well as feeding depleted electrolyte to add magnesium chloride thereto.

As used herein "an electrolyte enriched in magnesium chloride" is an electrolyte containing from 30 to 50% by weight magnesium chloride. As used herein "a recycled electrolyte" is an electrolyte that is passed through a bank of electrolysis cells series-connected by conduits and containing from 16 to 20% by weight magnesium chloride at the inlet side of the first electrolysis cell of the bank and from 8 to 12% by weight magnesium chloride at the outlet side of the last cell. In practice, the aforementioned method will make it possible to centrally prepare the starting materials for the electrolysis, to substantially reduce the scope of maintainance of the electrolysis cells, and to enhance labor efficiency, and to improve working conditions.

The prior-art method contemplates concentration of the whole amount of the recycled electrolyte, that has undergone the electrolytic treatment, in the electrolysis cells, whereby the flow of the enriched electrolyte passed to be refined is increased and the degree of refining the electrolyte supplied to the bank of the electrolysis cells is reduced. Since the enriched electrolyte is of an inferior quality, the processing characteristics of the electrolytic cells will also be an inferior quality, such as current efficiency, specific current consumption, etc. In addition, mixing of the material containing an appreciable amount of magnesium chloride (around 100%) with the recycled electrolyte is accompanied by a high heat evolution which is due to exothermic reactions occuring when magnesium chloride comes in contact with the components of the recycled electrolyte such as sodium chloride and potash chloride. This leads to overheating of the electrolyte supplied to the bank of the electrolysis cells and hence to disturbances in performance of the electrolysis cells. Also, heating of the recycled electrolyte containing the magnesium extracted in the electrolytic cells is required to improve conditions for the separation of the magnesium from the recycled electrolyte and to get a more refined magnesium to be withdrawn from the process, which increases power consumption per unit end product.

The prior art also teaches a method of the continuous electro-winning of magnesium (USSR Inventor's Certificate No. 259,401) which comprises the steps of enriching an electrolyte in magnesium chloride, refining the electrolyte, feeding the resultant electrolyte to a bank of electrolytic cells series-connected by conduits, carrying the electrolyte containing the magnesium in the electrolytic cells, separating the magnesium from the electrolyte, accumulating the magnesium and withdrawing the same from the process and delivering the electrolyte to add magnesium chloride, the flow of the recycled electrolyte following the step of separating the magnesium being divided into several flows of which one is delivered to be enriched in magnesium chloride and the rest are added to the electrolyte enriched in magnesium chloride following the step of its refining.

The above-described method permits the flow of the concentrated electrolyte, that is fed for refining, to be decreased and hence to improve the quality of the electrolyte supplied to the electrolytic cells.

However, the problems of the exothermic heat, current consumption and the optimum performance of the electrolytic cells is to be solved.

The above method may be practiced in a processing line comprising electrolytic cells connected by conduits to perform the steps of enriching the electrolyte in magnesium chloride, separating magnesium from the electrolyte, refining the electrolyte and dividing the same into several flows. Yet a single multiple-cells flow apparatus as disclosed in USSR Inventor's Certificate No. 487,287 is believed to be more suitable for carrying out the steps of enriching the electrolyte in magnesium chloride, separating magnesium from the electrolyte, and dividing the electrolyte into several flows. The apparatus comprises a chamber for separating magnesium from the electrolyte, a chamber for enriching the electrolyte in magnesium chloride, and a chamber for dividing the electrolyte into two or more flows. The chambers are separated by walls. In the apparatus the chamber for enriching the electrolyte in magnesium chloride is disposed between the chamber for separating magnesium from the electrolyte and the chamber for dividing the electrolyte into flows. The walls separating the chambers are provided with overflow passages through which the electrolyte flows from one chamber into another. The above apparatus as utilized in practicing the above method will make for a considerable reduction in the length of conduits and save labor.

However, there is still a need for heating of the electrolyte to 670° to 720° C. in the chamber for separating magnesium from the electrolyte in order to maintain optimum conditions therein, namely skull prevention and complete magnesium separation. Such heating entails extra power consumption and a respective high power consumption per unit end product. The temperature of the recycled electrolyte is still high (750°–770° C.).

SUMMARY OF THE INVENTION

An object of the invention is to reduce power consumption per unit end product.

Still another object of the invention is to improve the quality of the electrolyte fed into the electrolytic process.

The invention is directed to the provision of a method of continuously extracting magnesium, and a multiple-cell flow apparatus for a processing line used to practice the method, which method due to a certain sequence of steps, and which apparatus, due to its structural features, make it possible to reduce power consumption per unit end product and to improve the quality of the electrolyte fed into the electrolytic process.

These and other objects of the invention are attained by the provision of a method of continuously extracting magnesium, comprising the steps of enriching an electrolyte in magnesium chloride and purifying the same, feeding the electrolyte to a bank of electrolytic cells series-connected by conduits, delivering the electrolyte containing the magnesium extracted in the electolytic cells to separate the magnesium, separating the magnesium from the electrolyte, accumulating the magnesium and withdrawing the same from the process, feeding the electrolyte to enrich the same. According to the invention the enriched electrolyte is mixed with a recycled electrolyte containing the magnesium extracted in the electrolytic cells, the resultant electrolyte is subjected to separation and then divided into two flows of which one is directed to be enriched, while the other is directed into the electrolytic cells.

The method of the invention provides for a reduction in power consumption per unit end product.

The reduction in power consumption per unit end product is realized by utilizing the heat of exothermic reactions occuring when magnesium chloride comes in contact with the components of the electrolyte such as sodium chloride and potash chloride. Excess heat evolved during the mixing process is used to compensate for heat losses from the chambers for enriching, refining, separating and dividing the electrolyte or from multiple-cell flow apparatus and from the conduits. Also, the electrolyte containing magnesium that is fed for separation is heated to a temperature which permits the maximum separation of magnesium. The heat evolved from exothermic reactions obviates the need for external heating of the apparatus and is helpful in maintaining the temperature of the electrolyte fed to the electrolytic cells so that it does not exceed the upper tolerance limit. The method also provides for improved quality characteristics of the electrolyte fed to the electrolytic cells, since the starting material contains a considerable amount of admixtures (both dissolved and undissolved), the quality of the electrolyte is improved through reduction in volume of the electrolyte fed to the electrolytic cells following the step of enriching the electrolyte in magnesium chloride. This will accordingly improve performance of the electrolytic cells.

It is advisable to divide the electrolyte into two flows in the ratio of 0.10:0.40 of which the former is the electrolyte flowing to be enriched and the latter is the electrolyte flowing to the electrolytic cell.

This modification of the method provides for a reduction in the volume of the electrolytic to be refined, by a factor of 4 to 10, and a respective improvement in the quality of the electrolyte.

The above objects are attained by providing a multiple-cell flow apparatus for a processing line used for practicing the method of continuously extracting magnesium. The apparatus comprises a chamber for enriching an electrolyte in magnesium chloride. The wall of the chamber has a passage for establishing communication with a chamber for separating magnesium from the electrolyte through a corresponding passage in the wall thereof as well as a chamber for dividing the electrolyte into flows. According to the invention the chamber for dividing the electrolyte into flows is disposed between the chambers for enriching the electrolyte and the chamber for separating the magnesium from the electrolyte.

The above apparatus, as used for practicing the method, permits the heat of the exothermic reactions to be utilized, provides for heating the electrolyte fed to be separated from magnesium to 700° to 720° C., which temperature is effective for the maximum separation of magnesium. Also, the apparatus does not permit the temperature of the electrolyte fed to the bank of electrolyte cells to exceed the upper tolerance limit. It is advisable to provide the passage in the wall of the chamber for enriching the electrolyte, above the passage in the wall of the chamber for separating the electrolyte. Such arrangement of the passage eliminates the need of various means for a positive delivering of the electrolyte from the chamber for enriching thereof to the separation chamber and provides for a free (spontaneous) flow of the electrolyte from the concentration chamber to the separation chamber.

It is preferred to provide the concentration chamber with vertical walls having overflow passages and to divide the chamber into zones in series, namely a concentration zone, a sedimentation zone for settling down insoluble admixtures present in a concentrated electrolyte, and a zone for electrochemical purification of the electrolyte with electrodes disposed therein. Such design of the concentration chamber provides for a reduction in length of conduits, saves labor in servicing the apparatus, and improves working conditions. The best ratio of the volume of the concentration zone to that of the zone of settling suspended matter is in the range of 0.2 to 0.5.

The given ratio of the volume of the concentration zone to that of the settling zone affords a dwell time in the settling zone sufficient for the electrolyte to be highly purified from insoluble admixtures.

The electrodes in the zone of electrochemical purification are preferably disposed at right angles to the alternately adjoining opposite walls defining the zone. Such arrangement of the electrodes allows the electrolyte to dwell in the zone of electrochemical purification a longer period of time thereby increasing the quality of the electrolyte from 4 to 5 times.

BRIEF DESCRIPTION OF THE DRAWINGS

Now the invention will be described by way of specific examples with reference to the accompanying drawings wherein.

DETAILED DESCRIPTION OF THE INVENTION

Figure 1:
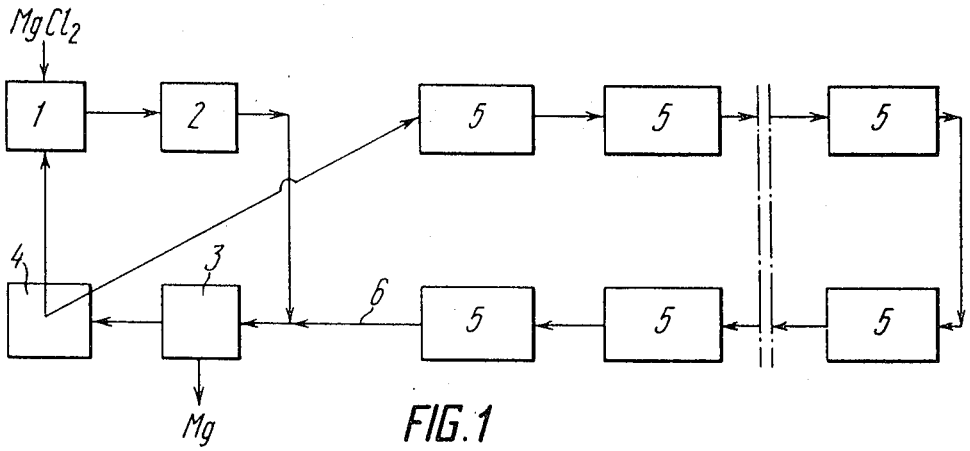
FIG. 1 is a diagrammatic representation of a processing line for continuously extracting magnesium, wherein the enriched electrolyte and the recycled electrolyte are mixed in a conduit before the separation chamber.

With the purpose of carrying out the method there are utilized levelled off and connected by conduits pieces of equipment such as a chamber 1 for enriching an electrolyte in magnesium chloride, a chamber 2 for refining the electrolyte, a chamber 3 for separating magnesium from the electrolyte, a chamber 4 wherein the electrolyte is divided into two flows and electrolytic cells 5.

After the chambers and the electrolytic cells 5 have been filled with a fused electrolyte the cells are connected to a D.C. source, the current being a function of a department efficiency and the cell type. Then the electrolyte from the chamber 4 is fed to the first cell in the downstream direction, this being effected by suitable pumps designed for aggressive media and other conventional means. The chamber 1 is supplied with starting materials and an electrolyte from the chamber 3 separated from magnesium extracted in cells 5. The resultant electrolyte obtained by mixing in the chamber 1 and enriched in magnesium chloride at a temperature of 750° to 770° C., is purified in the chamber 2, is delivered by gravity to be mixed with a recycled electrolyte having the temperature of 670° to 680° C., and is fed for separation from the magnesium extracted in the electrolytic cells.

Following the mixing step the electrolyte at 700° to 730° C. and containing from 16 to 20% by weight magnesium chloride, and the magnesium extracted in the electrolytic cells if fed into the chamber 3 to be separated from the magnesium. The magnesium is accumulated in this chamber, then is refined to separate admixtures (iron, chlorine ion, etc.) and shipped to consumers. The electrolyte that has been separated from magnesium in the chamber 3 is further supplied to the chamber 4 to be divided into two flows, one of which is directed to be enriched in magnesium chloride to the chamber 1 wherein the electrolyte is heated to 750° to 770° C. and acquires a content of magnesium chloride of 30 to 50% by weight thereof, while the other having the temperature of 700° C. is fed to a bank of the electrolytic cells 5 series-connected by conduits.

FIG. 1 is an illustration of one way of practicing the method wherein the enriched electrolyte and the recycled electrolyte are mixed in a conduit 6 through which the resultant electrolyte is directed into the chamber 3 to be separated from magnesium.

Figure 2:
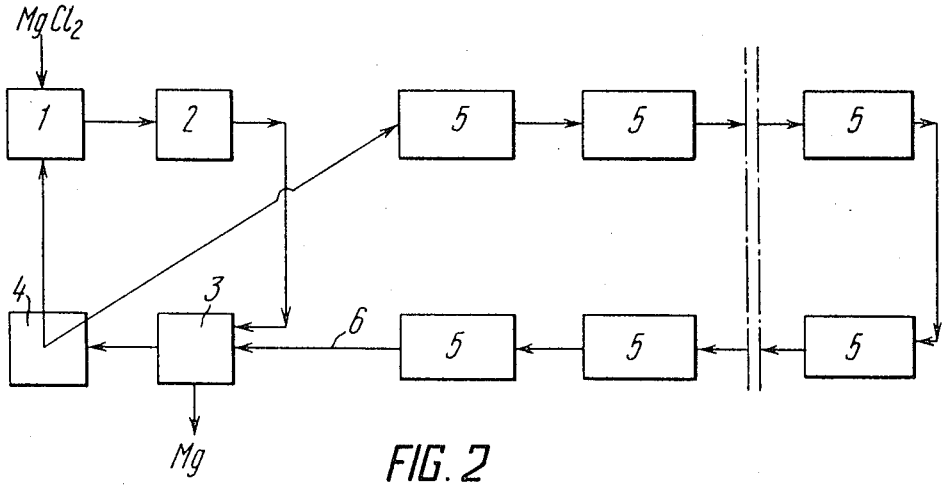
FIG. 2 is a diagrammatic representation of a processing line for continuously extracting magnesium, wherein the enriched electrolyte and the recycled electrolyte are mixed in the separation chamber.

An alternative way of practicing the method (FIG. 2) contemplates in the chamber 3, carrying out the step of mixing the electrolyte enriched in magnesium chloride with the recycled electrolyte carried together with the extracted magnesium to separation.

Figure 3:
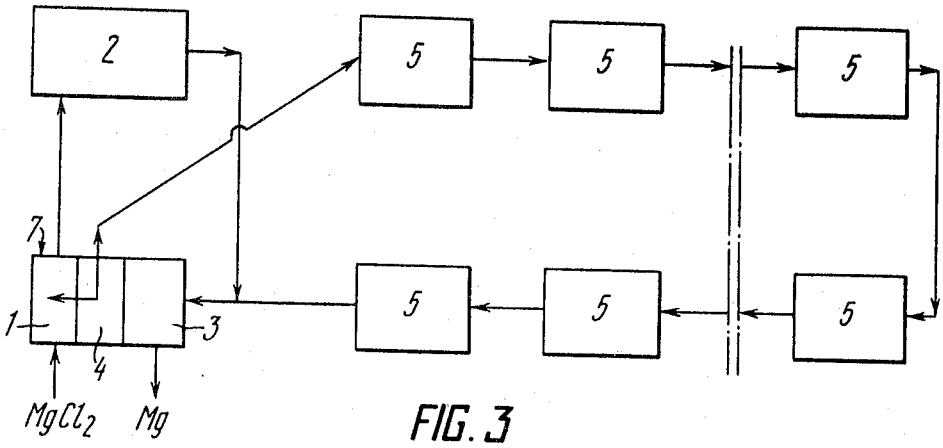
FIG. 3 is a diagrammatic representation of a processing line for continuously extracting magnesium, wherein a multiple-cell flow apparatus is incorporated and the electrolyte flows are mixed in a duct prior to entry the multiple-cell flow apparatus.
Figure 4:
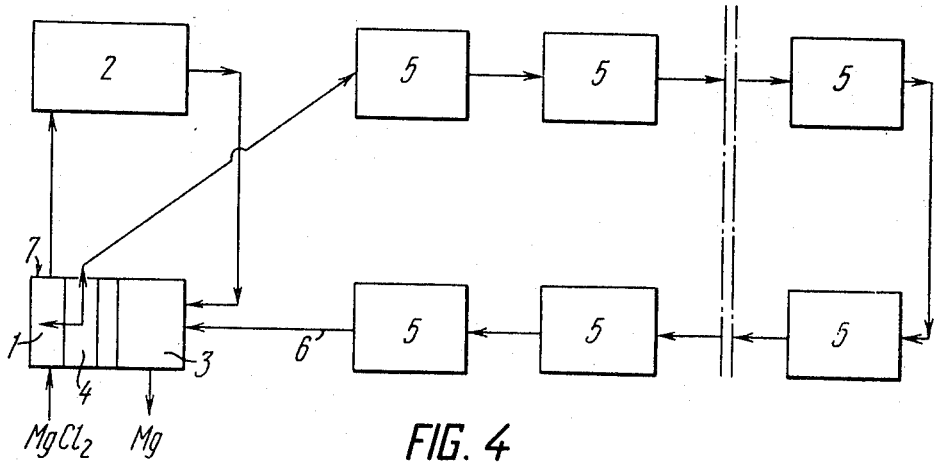
FIG. 4 is a diagrammatic representation of a processing line for continuously extracting magnesium, wherein a multiple-cell flow apparatus is employed and the electrolytes are mixed in the multiple-cell apparatus.
Figure 5:
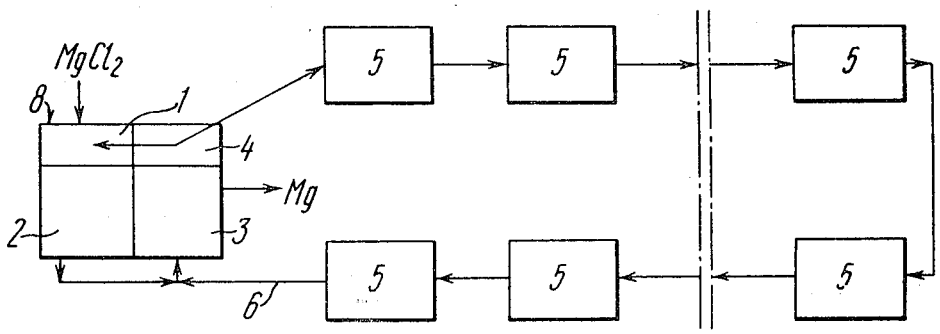
FIG. 5 is a diagrammatic representation of a processing line for continuously extracting magnesium, wherein a modified multiple-cell flow apparatus is employed and the electrolytes are mixed in a conduit prior to entry into the apparatus.
Figure 6:
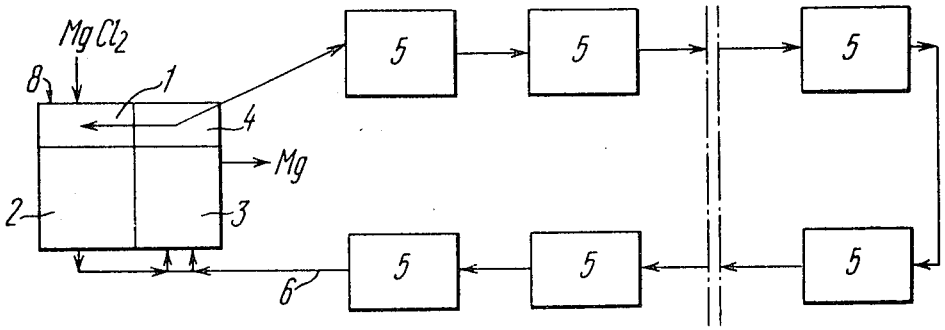
FIG. 6 is a diagrammatic representation of a processing line for continuously extracting magnesium, wherein a modified multiple-cell flow apparatus is employed and the electrolytes are mixed in the apparatus.

The choice of the way of practicing the method depends on the equipment used. A multiple-cell flow apparatus 7 may be used to perform the steps of enriching the electrolyte in magnesium chloride (chamber 1), separating magnesium from the electrolyte (chamber 3) and dividing the electrolyte into two flows (chamber 4) as represented in FIGS. 3 and 4. The step of refining the electrolyte from admixtures is carried out in the chamber 2 (FIGS. 3 and 4) of the just described apparatus. A multiple-cell flow apparatus 8 (FIGS. 5 and 6) may also be used to perform the step of enriching the electrolyte in magnesium chloride (chamber 1), refining the resultant electrolyte (chamber 2), separating magnesium from the electrolyte (chamber 3) and dividing the electrolyte into two flows (chamber 4). When both the above apparatus (FIGS. 3 through 6) are used, two ways of practicing the method are possible:

the step of mixing the electrolyte enriched in magnesium chloride with the recycled electrolyte delivered to be separated from the magnesium extracted in the electrolytic cell is carried out in the conduit 6;

the step of mixing the enriched electrolyte with the recycled one is carried out in the chamber 3. The sequence of steps, temperature conditions and the electrolyte concentration are the same as described above.

Figure 8:
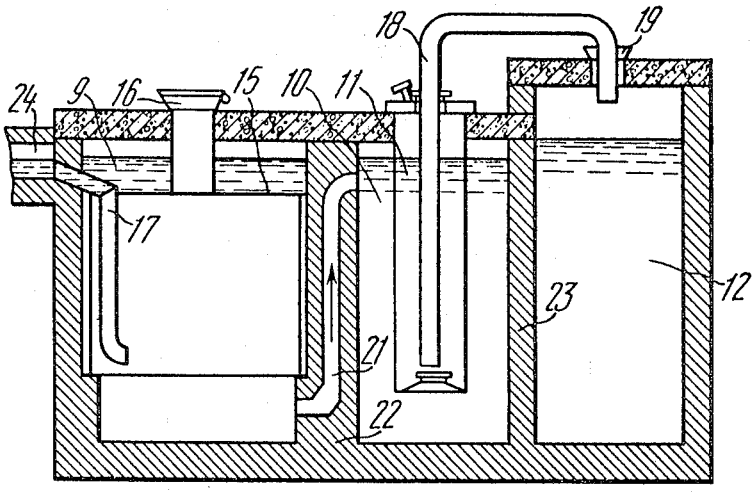
FIG. 8 is a diagrammatic sectional view through the separation chamber, the dividing chamber and the concentration chamber of a multiple-cell flow apparatus.
Figure 7:
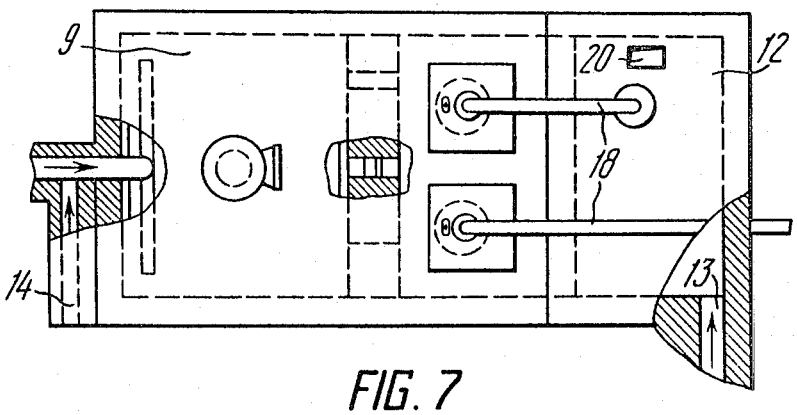
FIG. 7 is a diagrammatic representation of a multiple-cell flow apparatus (top plan view)

A processing line used for carrying out the above method of continuously extracting magnesium by subjecting chloride electrolytes to electrolysis may equally contain a multiple-cell flow apparatus comprising a chamber 9 defined by vertically extending walls and a bottom and intended for separating magnesium from the electrolyte (FIGS. 7 and 8), a chamber 10 for dividing the electrolyte into two flows, which division is carried out by pumps 11 and a chamber 12 for enriching the electrolyte in magnesium chloride. One of the walls of the chamber 12 has a passage 13 to establish communication with the chamber 9 through a respective passage 14 in a wall thereof. The chamber 9 houses a receiver 15 for accumulating magnesium having a neck portion 16 and a distributor 17. The pumps 11 in the chamber 10 are provided with discharge means 18 for supplying the electrolyte into the chamber 12 and to a bank of electrolytic cells (not shown). The chamber 12 is provided with a device 19 for filling the electrolyte and with a device 20 for filling a magnesium chloride material. An overflow passage 21 in the wall 22 is provided for passing the electrolyte from the chamber 9 to the chamber 10. A common wall 23 disposed between the chambers 10 and 12 is a solid member. A passage 24 connecting the multiple-cell flow apparatus with electrolytic cells (not shown) is provided for supplying the recycled electrolyte containing the magnesium extracted in the electrolytic cells to the chamber 9.

Figure 9:
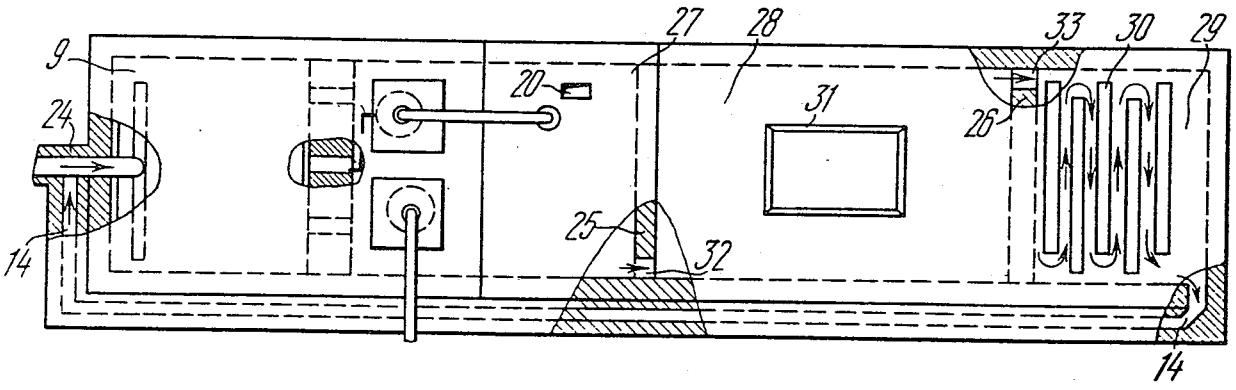
FIG. 9 is a diagrammatic sectional view through coaxial zones of a modified multiple-cell flow apparatus (top plan view)
Figure 10:
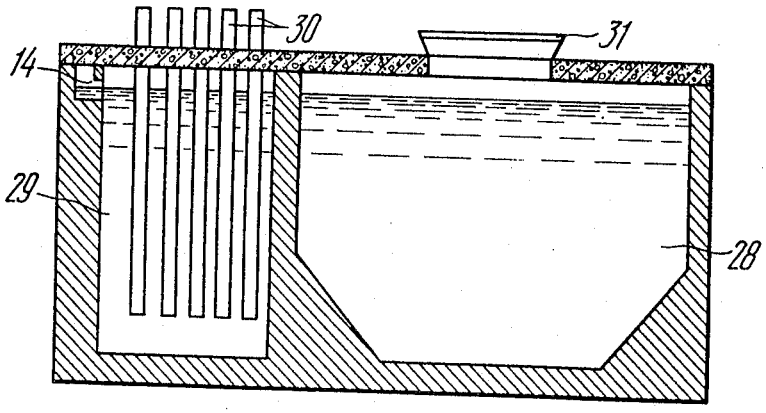
FIG. 10 is a diagrammatic sectional view through the settling zone and the electrochemical purification zone of a modified multiple-cell flow apparatus.

The electrolyte may be fed positively from the chamber 12 into the chamber 9 by any suitable means but the best way for such arrangement of the chambers is to let a free (spontaneous) overflow of the electrolyte. To this effect the passage 13 in the wall of the chamber 12 is provided above the passage 14 in the wall of the chamber 9. In order to have an electrolyte containing impurities within desired limits the chamber 12 is preferably divided by vertically extending walls 25 and 26 (FIGS. 9 through 11) defining a series of zones, namely a zone 27 for enriching the electrolyte in magnesium chloride, a zone 28 for settling insoluble admixtures from the enriched electrolyte and a zone 29 for subsequent electrochemical purification of the same electrolyte wherein D.C. electrodes 30 are disposed. This embodiment may comprise all the zones 27, 28 and 29 of the concentration chamber 12 arranged on a common axis with the chambers 9 and 10 (FIG. 9). With the end of improving conditions for servicing the apparatus and reducing the length of the passage 14 (FIG. 11) the zones 28 and 29, however, are preferably arranged on an axis in parallel with the axis of the chambers 9 and 10 and of the zone 27.

Figure 11:
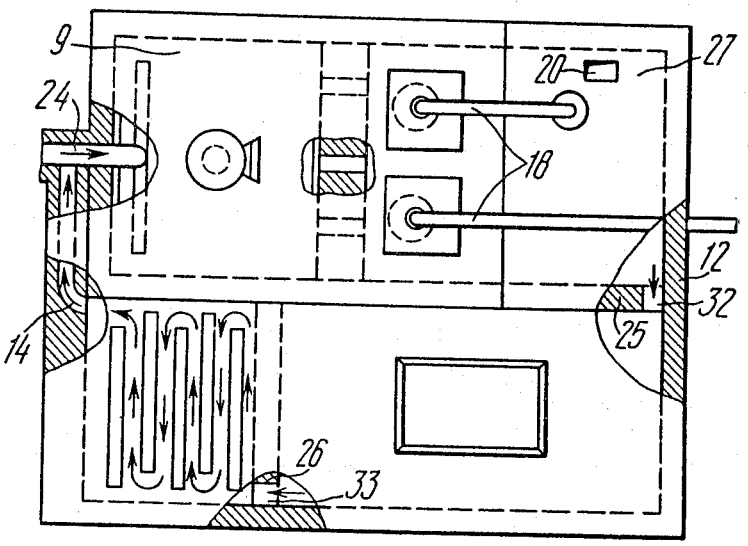
FIG. 11 is a diagrammatic representation of a modified multiple-cell flow apparatus with the settling zone and the electrochemical purification zone each arranged on parallel axes (top plan view).

The zone 28 has a port 31 provided for removing the settled admixtures each time as they accumulate in the zone 28. The walls 25 and 26 defining the zones 27, 28 and 29 are provided with passages 32 and 33 which permit the electrolyte to flow from zone to zone. To let a free flow of the electrolyte from the chamber 12 into the chamber 9 the passage 32 is made at a higher elevation than the passage 14 (FIGS. 9 and 11).

The best relation of the volume of the concentration zone 27 and the settling zone 28 is expressed as a quotient of the former and the latter in the range of 0.2 to 0.5. If the relation is reduced than the apparatus will be oversized to an extent unjustified while the reverse action will reduce the dwell time of the electrolyte in the zone 28 and so the quality of the electrolyte. It is in accord with the invention that the electrodes 30 in the zone 29 be vertically disposed and alternately adjoined to the opposite walls of the same zone, which promotes an extension of dwell time of the electrolyte in the zone and an improvement in the quality of the electrolyte.

The above-described multiple-cell flow apparatus operates as follows. The electrolyte containing the magnesium chloride extracted in the bank of the electrolytic cells (FIG. 1) is delivered, through the conduit 24 and the distributor 17, to the chamber 9 for separating the magnesium from the electrolyte. The electrolyte separated from the magnesium flows to the chamber 10 via the passage 21 in the wall 22. Now by the use of the pumps 11 the electrolyte is divided into two flows, which flows are directed via the discharge means 18 into the receiver 19 and into the bank of the electrolytic cells series-connected by conduit (not shown). In the chamber 12 the level of the electrolyte is maintained higher than that in the chambers 9 and 10 due to positive delivery by the pump 11.

A difference in the levels of the electrolyte causes the same to flow into the passage 24 connecting the apparatus to the processing line. The starting material containing magnesium chloride in an amount approaching 100% is charged in the melt form into the chamber 12 through the device 20. In case the apparatus having the concentration chamber 12 divided by the walls into zones (FIGS. 9 through 11) is used the electrolyte, following the step of enriching in magnesium chloride, is delivered into the zone 28 for settling down insoluble admixtures, next it is delivered into the zone 29 of electrochemical purification and further on via the passage 14 into the passage 24 to be mixed with the recycled electrolyte flowing into the chamber 9 for separating magnesium from the electrolyte.

Specific examples illustrating how to practice the method of the invention follow.

EXAMPLE 1

The method of continuously extracting magnesium according to the invention was carried out as follows.

The chamber for enriching an electrolyte in magnesium chloride was charged with a starting material heated to a temperature of 750° C. and containing approximately 100% magnesium chloride. An electrolyte heated to a temperature of 732° C. in an amount of 21 tons, following the step of enriching to 50 mess.% magnesium chloride and subsequent purifying was mixed with 87 tons of the recycled electrolyte containing 10 mess.% magnesium chloride and heated to a temperature of 670° C. The resultant electrolyte in an amount of 108 tons and containing 18 mess.% magnesium chloride at 710° C. was delivered in to the chamber for separating magnesium from the electrolyte. Following the separation step the electrolyte was divided into two flows of which one containing 18 mess.% magnesium chloride at 702° C. was directed for enriching. The other flow of the electrolyte containing 18 mess.% magnesium chloride at 695° C. was directed to a bank of electrolytic cells. The ratio of the flow directed for enriching to that directed to the bank of electrolytic cells, expressed as a quotient of the former and the latter flows, was 0.1.

The method of the invention carried out as above provides for a 500 (kWh/t.MgI) decrease in current consumption per unit end product as compared with the prior art method disclosed in USSR Inventor's Certificate No. 259,401.

The method also provides for an improvement in the quality of the electrolyte that is fed to the bank of electrolytic cells, which leads to an increase in current efficiency of the electrolytic cells used by a factor of approximately 0.5% and to a corresponding increase in the efficiency of the processing line.

EXAMPLE 2

The method of continuously extracting magnesium according to the invention was carried out as follows.

The chamber for enriching an electrolyte in magnesium chloride was charged with a starting material heated to a temperature of 750° C. and containing approximately 100% magnesium chloride. An electrolyte heated to a temperature of 741° C. in an amount of 27 tons, following the step of enriching to 42 mess.% magnesium chloride and subsequent purifying, was mixed with 87 tons of the recycled electrolyte containing mess.% magnesium chloride and heated to a temperature of 670° C. The resultant electrolyte in an amount of 114 tons and containing 18 mess.% magnesium chloride at 741° C. was delivered into the chamber for separating magnesium from the electrolyte. Following the separation step the electrolyte was divided into two flows of which one containing 18 mess.% magnesium chloride at 708° C. was directed for enriching. The other flows of the electrolyte containing 18 mess.% magnesium chloride at 702° C. was directed to a bank of electrolyte cells. The ratio of the flow directed for enriching to that directed to the bank of electrolytic cells, expressed as a quotient of the former and the latter flows, was 0.2.

The method of the invention carried out as above provides for a 600 (kWh/t.MgI) decrease in current consumption per unit end product as compared with the prior art method disclosed in USSR Inventor's Certificate No. 259,401.

The method also provides for an improvement in the quality of the electrolyte that is fed to the bank of electrolytic cells, which leads to an increase in current efficiency of the electrolytic cells used by a factor of approximately 1.0% and to a corresponding increase in the efficiency of the processing line.

EXAMPLE 3

The method of continuously extracting magnesium according to the invention was carried out as follows.

The chamber for enriching an electrolyte in magnesium chloride was charged with a starting material heated to a temperature of 750° C. and containing approximately 100% magnesium chloride. An electrolyte heated to a temperature of 748° C. in an amount of 45 tons following the step of enriching to 34 mess. % magnesium chloride and subsequent purifying, was mixed with 87 tons of the recycled electrolyte containing 10 mess.% magnesium chloride and heated to a temperature of 670° C. The resultant electrolyte in an amount of 132 tons and containing 18 mess.% magnesium chloride at 720° C. was delivered into the chamber for separating magnesium from the electrolyte. Following the separation step the electrolyte was divided into two flows of which one containing 18 mess.% magnesium chloride at 715° C. was directed for enriching. The other flow of the electrolyte containing 18 mess.% magnesium chloride at 712° C. was directed to a bank of electrolytic cells. The ratio of the flow directed for enriching to that directed to the bank of electrolytic cells, expressed as a quotient of the former and the latter flows, was 0.4.

The method of the invention carried out as above provides for a 500 (kWh/t.MgI) decrease in current consumption per unit end product as compared with the prior art methods disclosed in USSR Inventor's Certificate No. 259,401.

The method also provides for an improvement in the quality of the electrolyte that is fed to the bank of electrolytic cells which leads to an increase in current efficiency of the electrolytic cells used by a factor of approximately 0.5% and to a corresponding increase in the efficiency of the processing line.

EXAMPLE 4 (COMPARATIVE)

The chamber for enriching an electrolyte in magnesium chloride was charged with a starting material heated to a temperature of 750° C. and containing approximately 100% magnesium chloride. An electrolyte heated to a temperature of 727° C. in an amount of 18 tons, following the step of enriching to 54 mess.% magnesium chloride and subsequent refining, was mixed with 87 tons of the recycled electrolyte containing 10 mess.% magnesium chloride and heated to a temperature of 670° C. The resultant electrolyte in an amount of 105 tons and containing 18 mess.% magnesium chloride at 705° C. was delivered into the chamber for separating magnesium from the electrolyte. Following the separation step the electrolyte was divided into two flows of which one containing 18 mess.% magnesium chloride at 700° C. was directed for enriching. The other flow of the electrolyte containing 18 mess.% magnesium chloride at 693° C. was directed to a bank of electrolytic cells. The ratio of the flow directed for enriching to that directed to the bank of electrolytic cells, expressed as a quotient of the former and the latter flows, was 0.7.

In practicing the method the enriched electrolyte contains more than 50 mess.% magnesium chloride. The electrolytes of such a $MgCl_2$ content are known for a very high rate of hydrolysis resulting in the formation of a considerable amount of magnesium oxide (an insoluble admixture) which impaires the quality of the electrolyte. The above method is characterized by 1.5% as low current efficiency as that of the method of the invention.

EXAMPLE 5 (COMPARATIVE)

The chamber for enriching an electrolyte in magnesium chloride was charged with a starting material heated to a temperature of 750° C. and containing approximately 100% magnesium chloride. An electrolyte heated to a temperature of 765° C. in an amount of 57 tons, following the step of enriching to 30 mess.% magnesium chloride and subsequent purifying was mixed with 87 tons of the recycled electrolyte containing 10 mess.% magnesium chloride and heated to a temperature of 670° C. The resultant electrolyte in an amount of 144 tons and containing 18 mess.% magnesium chloride at 738° C. was delivered into the chamber for separating magnesium from the electrolyte. Following the separation step the electrolyte was divided into two flows of which one containing 18 mess.% magnesium chloride at 732° C. was directed for enriching. The other flow of the electrolyte containing 18 mess.% magnesium chloride at 729° C. was directed to a bank of electrolytic cells. The ratio of the flow directed for enriching to that directed to the bank of electrolytic cells, expressed as a quotient of the former and the latter flows, was 0.5.

In practicing the method the electrolyte fed to the bank of electrolytic cells has a temperature exceeding that of the upper tolerance limit. Such an overheated electrolyte will cause disturbances in performance of the electrolytic cells. Moreover the volume of the electrolyte to be refined increases, thereby impairing the quality of the electrolyte. The above method is characterized by 1.5% as low current efficieny as that of the method of the invention.

While there have been described but some specific embodiments, it is to be understood that other embodiments are likewise possible within the spirit and scope of the invention as set forth in the appended claims.

What is claimed is:

1. A method of continuously extracting magnesium by subjecting chloride electrolytes to electrolysis, which method comprises the steps of: enriching an electrolyte in magnesium chloride and purifying the same, mixing said enriched electrolyte with a recycled electrolyte containing the metal magnesium extracted in electrolytic cells.

separating the metal magnesium from the resultant electrolyte, dividing said electrolyte into two flows of which one is fed to be enriched, while the other is delivered to a bank of electrolytic cells series-connected by conduits, delivering said recycled electrolyte containing the extracted metal magnesium for mixing with said enriched electrolyte prior to the step of separation, and accumulating the metal magnesium and withdrawing the same from the process.

2. A method as claimed in claim 1 wherein the ratio of the volume of said flow directed for enriching to that of the flow directed to the bank of electrolytic cells ranges from 0.10 to 0.40.

3. A method as claimed in claim 1 wherein the magnesium chloride of the flow directed for enriching is at a slightly higher temperature than the magnesium chloride of the flow directed to the bank of electrolytic cells.

4. A method as claimed in claim 1 wherein heat is evolved during said mixing step from an exothermic reaction occurring between the magnesium chloride and components of the electrolyte and wherein said evolved heat is used to compensate for heat losses occurring during the enriching, purifying, separating and dividing steps.

* * * * *